United States Patent [19]

Baffo

[11] 3,978,963

[45] Sept. 7, 1976

[54] FORWARD AND REVERSE INDEXING MECHANISM FOR AUTOMATIC TYPEWRITER

[75] Inventor: Mariano Baffo, Woburn, Mass.

[73] Assignee: Ty-Data, Inc., Nashua, N.H.

[22] Filed: June 4, 1975

[21] Appl. No.: 583,679

[52] U.S. Cl. ..... 197/114 R; 197/120; 197/127 R

[51] Int. Cl.[2] ..... B41J 19/90

[58] Field of Search ..... 197/19, 20, 114 R, 120, 197/127 R, 133 R

[56] References Cited

UNITED STATES PATENTS

| | | | |
|---|---|---|---|
| 2,791,311 | 5/1957 | Yerks et al. | 197/114 R |
| 3,640,370 | 2/1972 | Denley | 197/114 R |

OTHER PUBLICATIONS

IBM Tech. Disc. Bulletin, J. B. O'Daniel et al., vol. 10, No. 12, May 1968, p. 1904.

IBM Tech. Disc. Bulletin, G. T. Miles, vol. 7, No. 11, Apr. 1965, pp. 1082–1083.

*Primary Examiner*—Edgar S. Burr
*Assistant Examiner*—Paul T. Sewell
*Attorney, Agent, or Firm*—Cesari and McKenna

[57] ABSTRACT

A combined forward and reverse indexing mechanism for an automatic typewriter. A pivotally mounted actuator arm is interposed between a common cam drive mechanism in the typewriter and either a forward indexing linkage or a reverse indexing linkage. An electromagnet selectively pivots the actuator arm to engage the forward or reverse linkage and to rotate the typewriter platen in a forward or reverse direction, respectively.

5 Claims, 2 Drawing Figures

FORWARD AND REVERSE INDEXING MECHANISM FOR AUTOMATIC TYPEWRITER

CROSS REFERENCE TO RELATED APPLICATION

This application incorporates subject matter which is also disclosed in application Ser. No. 583,678 filed by William F. Brine, Jr. and Mariano Baffo herewith, entitled "Automatic Typewriter" and assigned to the same assignee as the present invention.

BACKGROUND OF THE INVENTION

This invention relates generally to automatic typewriters and, more particularly, to a combined forward and reverse indexing mechanism for use in such automatic typewriters.

Automatic typewriters are used in automated typing, computer, message transfer and other systems and applications. In such systems, these typewriters perform a data input and transmitting function and a signal receiving and data output function. During the first function, an operator strikes the typewriter keys simultaneously to type on that typewriter and, by means of various sensors, to transfer to signal processing equipment signals representing the typing operations being performed. In an automated typing system, this equipment comprises circuits for transferring the signals to a storage medium; in a computer system, a computer or an input/output controller; and in a message transfer system, another automatic typewriter.

During the signal receiving and data output function, the signal processing equipment transfers character and timing signals to the automatic typewriter. Various actuators cause the typewriter to print in response to these received signals.

A number of such automatic typewriters have been and are now available. They have become more popular, with the advent of code responsive, bail operated, electric typewriters. Such typewriters are marketed by IBM under the trademark "Selectric." These electric typewriters are sold both to offices for use as conventional electric typewriters and to other manufacturers for use as automatic typewriters in the foregoing and other applications.

Some automatic typewriters include a reverse indexing mechanism as well as a conventional, forward indexing mechanism. The inclusion of both mechanisms facilitates typing superscripts and subscripts and data plotting. As is well known, a forward indexing operation rotates the platen to a successive writing line on the paper, but does not return the carrier to the left margin, as a carriage return operation does. A reverse indexing mechanism rotates the platen "backward" to a new writing line above the original line on the paper.

There are several forward and reverse indexing mechanisms available in both standard and automatic typewriters. In some typewriters, separate forward and reverse indexing mechanisms even include separate power cams. This adds to the complexity and cost of the typewriter mechanism.

It has also been proposed to use a complex mechanical linkage to a single power cam effect both operations. An electromagnet is used to shift a pivot point for the linkage in response to signals from the signal processing equipment. This linkage, with its movable pivot, further complicates the typewriter mechanism.

Therefore, it is an object of this invention to provide a simplified forward and reverse indexing mechanism for use in automatic typewriters. Another object of this invention is to provide a reliable forward and reverse indexing mechanism for use in automatic typewriter.

SUMMARY OF THE INVENTION

In accordance with my invention, an electromagnetic unit moves an actuator arm between two positions. In a first, or deenergized position, the actuator arm couples a power cam to a forward indexing linkage and produces a conventional indexing operation. Conversely, when the electromagnetic unit is energized, it withdraws the actuator arm and couples the reverse linkage and the power cam to produce a reverse indexing operation.

This invention is pointed out with particularity in the appended claims. The foregoing and other features and advantages of the invention will be better understood by referrence to the following description taken in conjunction with the accompanying drawing:

BRIEF DESCRIPTION OF THE DRAWINGS

Referring to FIG. 1, the indexing mechanism operates in response to rotation of a power cam 12 attached to a rotatable power shaft 13. When the index key in a conventional code responsive, bail operated electric typewriter is depressed, it unlatches an index interposer and engages an index clutch mechanism causing cam 12 to rotate with the shaft 13. The resulting rotation of the cam 12 causes a cam follower 14 to move in the direction indicated by the arrow 15 in FIG. 1. Since cam follower 14 pivots on a shaft 17, a downward motion is in turn imparted to the rear arm 14A of the cam follower 14. In the conventional typewriter, the rear arm 14A of the cam follower is pivotally connected to one arm 18A of an index transfer bellcrank 18 by an index link (not shown). Thus, movement of the cam follower 14 in the direction of arrow 15 imparts, through the index link downward motion of the arm 18A of index transfer bellcrank 18 which pivots on a shaft 19. The other arm 18B of index transfer bellcrank 18 imparts motion to a forward index link 21, a forward index linkage 30 and forward index ratched 20 (FIG. 2) to rotate a typewriter platen 22 (FIG. 2) to a writing line below the original writing line on the paper.

Figure 1:
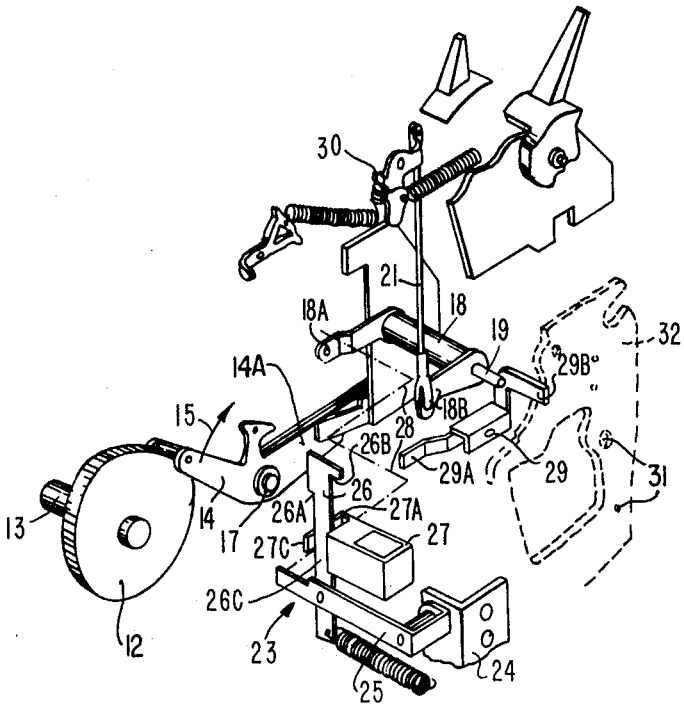
FIG. 1 is a right front perspective view, partly exploded, of an illustrative embodiment of the combined forward and reverse indexing mechanism of the present invention; and, FIG. 2 is a right rear perspective view of the mechanism shown in FIG. 1.

My indexing mechanism for both forward and reverse indexing operations is obtained by removing the index link 16 which connects the rear arm 14A of the cam follower 14 to the arm 18A of the bellcrank 18 in the conventional typewriter, as will become apparent. A combined forward and reverse actuator arm assembly 23 as shown in FIG. 1 is added. The actuator arm assembly 23 includes an auxiliary mounting bracket 24, an actuator arm 26 pivotally connected to an actuator lever 25 and extending upwardly therefrom, and an index actuating electromagnet 27 including a pivoted clapper 27A having an extension 27C which engages a central portion 26C of the actuator arm 26. The actuator arm assembly 23 is operatively disposed in the typewriter 11 by moving it into position as generally indicated by the dashed lines 28. The bracket 24 is secured in position using holes 31 in a right hand portion member 32 of the typewriter main frame. The actuator lever 25 is situated directly below the rear portion of cam follower 14. A ridge 26A extending to the left from the upper portion of actuator arm 26 in FIG. 1 is disposed directly above the left arm 18A of index transfer bellcrank 18.

When the electromagnet 27 is not energized, the modified structure of FIG. 1 indexes the platen 22 (FIG. 2) in a direction in response to rotation of the power cam 12.

Downward motion imparted to the rear of cam follower 14 is transfered by the actuator lever 25 to the actuator arm 26 and then to the index transfer bellcrank 18 and index pawl link 21 to the index pawl and forward ratchet 20 (FIG. 2) attached to the platen 22.

However, when the electromagnet 27 is energized, the clapper 27A draws the actuator arm 26 to the right in FIG. 1 and away from the left arm 18A of the index transfer bellcrank 18. The forward indexing mechanism in the typewriter is thereby deactivated, even though actuator lever 25 and actuator arm 26 still experience a downward movement when cam follower 14 is moved.

As shown in FIG. 1, a reverse index transfer link 29 pivots on a suitable mounting bracket (not shown) to main frame member 32. The link 29 includes a front portion 29A in FIG. 1 extending toward the front of typewriter 11 and a rear portion 29B extending to the right in FIG. 1. Another ridge 26B extending to the right from the upper portion of actuator arm 26 moves directly over the top of the front portion of the line 29A. The downward motion imparted to actuator arm 26 thus pivots link 29 in a counterclockwise direction thereby elevating the rear portion 29B.

Figure 2:
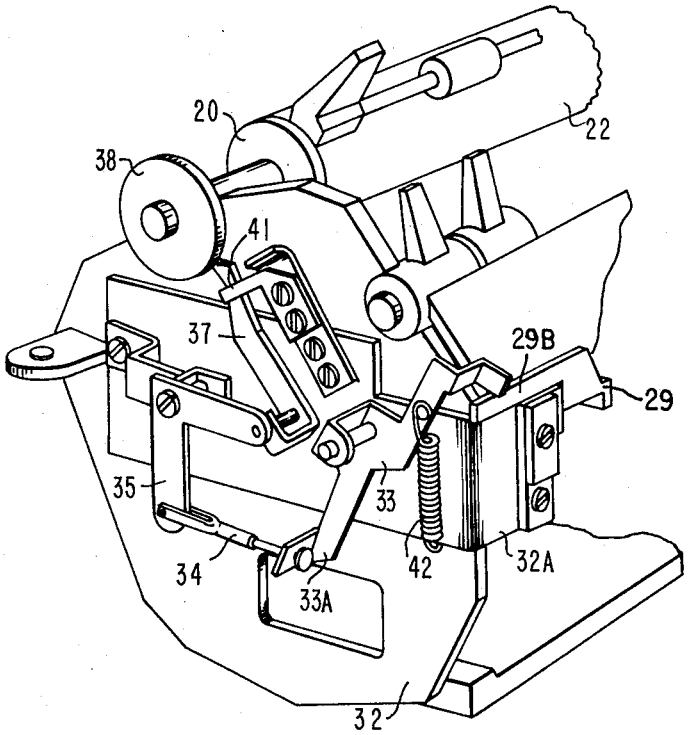

Now referring to FIG. 2, an auxiliary bracket 32A, mounted to existing holes in main frame member 32 provides a pivot support for a reverse index transfer link 33. Illustratively, the auxiliary bracket 32A extends along both sides of main frame member 32 and supports both the links 29 and 33. A lower end 33A of link 33 is connected by means of a threaded rod and clevis pin arrangement 34 to a reverse index pawl arm 35 which pivots on bracket 32A. The pawl arm 35 also connects to a reverse index pawl 37 which engages a reverse index ratchet 38 attached to the typewriter platen 22 to the outside of main frame member 32.

From FIG. 2, it can be seen that the upward movement of the rear portion 29B of the link 29 pivots the link 33 and moves the lower part of reverse index pawl arm 35 to the rear of the typewriter (the right in FIG. 2). The upper part of pawl arm 35 thus pushes the reverse index pawl 37 upwardly against reverse index ratchet 38 resulting in a counterclockwise movement of the typewriter platen. A pawl overthrow stop 41, which also mounts on the auxiliary bracket 32A, prevents further movement of pawl 37 when the typewriter platen reaches the desired position. A spring 42 disengages pawl 37 from ratchet 38 when the desired indexing operation is completed.

Thus, it is possible with the structure illustrated in FIGS. 1 and 2 to initiate either a forward or reverse indexing operation in the typewriter 11 by selectively energizing the electromagnet 27. Advantageously, the same index clutch mechanism, cam and cam follower in the typewriter 11 are used for both operations so separate mechanisms are not necessary. Moreover, the electromagnet 27 can be energized to initiate a reverse indexing operation by signals from the signal processing equipment or from a single reverse index key which is incorporated as part of the typewriter keyboard.

Thus, in accordance with my invention, a simple, inexpensive mechanism provides forward and reverse indexing operations in an automatic typewriter. It will be apparent that various other arrangements can be substituted for the specifically disclosed embodiment without departing from this invention. Therefore, it is the object of the appended claims to cover all such variations and modifications as come within the true spirit and scope of my invention.

What I claim as new and desire to secure by Letters Patent of the United States is:

1. A combined forward and reverse indexing mechanism for an automatic typewriter including a rotatable platen, a rotatable power shaft, a cam mounted on said shaft for rotation therewith and a cam follower operatively engaging said cam and movable in response to rotation thereof, said mechanism comprising:

A. a forward indexing ratchet attached to the platen;

B. forward indexing means for incrementing said forward indexing ratchet and rotating the platen in a first direction;

C. a reverse indexing ratchet attached to the platen;

D. reverse indexing means for incrementing said reverse indexing ratchet and rotating the platen in a second direction opposite to said first direction, E. means for selectively coupling motion of the cam follower to said forward and reverse indexing means, respectively, said coupling means comprising i. an actuator lever engaging the cam follower for movement therewith, ii. an actuator arm including a portion which is pivotally attached to said lever and a free end, iii. the free end of said arm being pivotal between first and second positions and having ridge means thereon so that in the first position the ridge means couples the motion of the cam follower only to said forward indexing means and in the second position the ridge means couples the motion of the cam follower only to said reverse indexing means, and F. means for engaging said actuator arm and for pivoting the free end of said actuator arm between the first and second positions.

2. A mechanism as recited in claim 1 in which said pivoting means comprises an electromagnet drive means which, when unenergized, holds the free end of said actuator arm in the first position, and which, when energized, pivots the free end of said actuator arm into the second position.

3. A mechanism as recited in claim 1 in which said automatic typewriter includes a frame member with two sides, said reverse indexing means including:

i. an auxiliary mounting bracket mounted to said frame member and extending along both sides thereof, ii. a first transfer link operatively engaged and movable by said actuator arm when the free end of said actuator arm is in said second position, said first transfer link being pivotally mounted to said auxiliary bracket on one side of said frame member, iii. a second transfer link operatively engaged and movable by said first transfer link, said second transfer link being pivotally mounted to said auxiliary bracket on the opposite side of said frame member.

4. A mechanism as recited in claim 3 in which said reverse indexing means further includes:

i. a reverse indexing pawl arm pivotally mounted to the same side of said auxiliary bracket as said second transfer link, said reverse indexing pawl arm being connected to said second transfer pink and movable therewith, and ii. a reverse indexing pawl pivotally connected to said reverse indexing pawl arm and movable therewith to engage said reverse indexing ratchet.

5. A mechanism as recited in claim 1 in which the ridge means of said actuator arm includes first and second ridges projecting from opposite sides of said arm, the first ridge operatively engaging said forward indexing means when the free end of said arm is in the first position and the second ridge operatively engaging said reverse indexing means when the free end of said arm is in the second position.

* * * * *